US010075800B2

(12) United States Patent
Sladeczek et al.

(10) Patent No.: US 10,075,800 B2
(45) Date of Patent: Sep. 11, 2018

(54) MIXING DESK, SOUND SIGNAL GENERATOR, METHOD AND COMPUTER PROGRAM FOR PROVIDING A SOUND SIGNAL

(71) Applicant: FRAUNHOFER-GESELLSCHAFT ZUR FÖRDERUNG DER ANGEWANDTEN FORSCHUNG E.V., München (DE)

(72) Inventors: Christoph Sladeczek, Ilmenau (DE); Annika Neidhardt, Erfurt (DE); Martina Böhme, Ilmenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/892,660

(22) PCT Filed: May 21, 2014

(86) PCT No.: PCT/EP2014/060481
§ 371 (c)(1),
(2) Date: Nov. 20, 2015

(87) PCT Pub. No.: WO2014/187877
PCT Pub. Date: Nov. 27, 2014

(65) Prior Publication Data

US 2016/0119734 A1 Apr. 28, 2016

(30) Foreign Application Priority Data

May 24, 2013 (DE) ..... 10 2013 105 375

(51) Int. Cl.
*H04R 29/00* (2006.01)
*H04S 7/00* (2006.01)
(Continued)

(52) U.S. Cl.
CPC ..... *H04S 7/301* (2013.01); *H04R 29/005* (2013.01); *H04S 7/30* (2013.01); *H04S 7/40* (2013.01);
(Continued)

(58) Field of Classification Search
CPC ... H04S 7/301; H04S 7/30; H04S 7/40; H04S 2400/11; H04S 2400/15; H04S 2420/01; H04R 29/005; H04R 5/027; G10L 19/008
See application file for complete search history.

(56) References Cited

U.S. PATENT DOCUMENTS

2008/0253547 A1* 10/2008 Berndt ..... H04M 3/567 379/202.01
2010/0208903 A1* 8/2010 Heigl ..... G08B 13/1672 381/58
(Continued)

FOREIGN PATENT DOCUMENTS

JP 2005223771 A 8/2005
WO WO96/21321 A1 6/1996
(Continued)

OTHER PUBLICATIONS

Jens Ahrens et al.; "Introduction to the SoundScape Renderer (SSR) Contents"; Nov. 13, 2012; pp. 1-38; XP055135549; https://dev.qu.tu-berlin.de/attachments/download/1283/SoundScapeRenderer-0.3.4-manual.pdf.
(Continued)

*Primary Examiner* — Sonia Gay
(74) *Attorney, Agent, or Firm* — 2SPL Patentanwaelte PartG mbB; Mani Arabi

(57) ABSTRACT

A mixing console (300) for processing at least a first and a second source signal and for providing a mixed audio signal comprises an audio signal generator (100) for providing an audio signal (120) for a virtual listening position (202)
(Continued)

within a space (200), in which an acoustic scene is recorded by at least a first microphone (204) at a first known position within the space (200) as the first source signal (210) and by at least a second microphone (206) at a second known position within the space (200) as the second source signal (212). The audio signal generator (100) comprises an input interface (102) configured to receive the first source signal (210) recorded by the first microphone (204) and the second source signal (212) recorded by the second microphone (206), and a geometry processor (104) configured to determine a first piece of geometry information (110) based on the first position and the virtual listening position (202) and a second piece of geometry information (112) based on the second position and the virtual listening position (202). A signal generator (106) for providing the audio signal (120) is configured to combine at least the first source signal (210) and the second source signal (212) according to a combination rule using the first piece of geometry information (110) and the second piece of geometry information (112).

13 Claims, 7 Drawing Sheets

(51) Int. Cl.
*G10L 19/008* (2013.01)
*H04R 5/027* (2006.01)

(52) U.S. Cl.
CPC ..... *G10L 19/008* (2013.01); *H04R 5/027* (2013.01); *H04S 2400/03* (2013.01); *H04S 2400/11* (2013.01); *H04S 2400/15* (2013.01); *H04S 2420/01* (2013.01)

(56) References Cited

U.S. PATENT DOCUMENTS

| | | | | |
|---|---|---|---|---|
| 2011/0064233 | A1* | 3/2011 | Van Buskirk ..... | G10H 1/0091 381/61 |
| 2012/0076304 | A1 | 3/2012 | Suzuki | |
| 2013/0121516 | A1* | 5/2013 | Lamb ..... | H04S 7/302 381/307 |
| 2014/0198918 | A1 | 7/2014 | Li | |
| 2014/0241529 | A1* | 8/2014 | Lee ..... | H04R 5/027 381/26 |

FOREIGN PATENT DOCUMENTS

| | | | |
|---|---|---|---|
| WO | 2008008417 | A2 | 1/2008 |
| WO | WO2009/077152 | A1 | 6/2009 |
| WO | 2013050575 | A1 | 4/2013 |

OTHER PUBLICATIONS

V. Pulkki; "Virtual Sound Source Positioning Using Vector Base Amplitude Panning"; Journal of the Audio Engineering Society, Audio Engineering Society, New York, NY, US; Bd. 45, Nr. 6, Jun. 1, 1997; pp. 456-466; XP002719359.

Elias Zey; "Binaural In-Ear Monitoring of Acoustic Instruments in Live Music Performance"; 15th International Conference on Digital Audio Effects; DAFX 2012 Proceedings; Jan. 1, 2012; XP055138455.

Giovanni Del Galdo et al: "Generating Virtual Microphone Signals Using Geometrical Information Gathered by Distributed Arrays"; 2011 Joint Workshop on Hands-free Speech Communication and Microphone Arrays, May 30-Jun. 1, 2011.

Richard Radke et al: "Audio Interpolation for Virtual Audio Synthesis"; AES 22nd International Conference on Virtual, Synthetic and Entertainment Audio.

* cited by examiner

MIXING DESK, SOUND SIGNAL GENERATOR, METHOD AND COMPUTER PROGRAM FOR PROVIDING A SOUND SIGNAL

CROSS-REFERENCE TO RELATED APPLICATIONS

This United States National Stage patent application claims priority under 35 U.S.C. § 119(a) to Germany Patent Application No.: DE102013105375.0, filed in Germany on May 24, 2013, the entire contents of which are hereby incorporated herein by reference.

BACKGROUND OF THE INVENTION

Embodiments of the present invention relate to a device, a method and a computer program for providing an audio signal which is based on at least two source signals which are recorded by microphones which are arranged within a space or an acoustic scene.

More complex recordings and/or acoustic scenes are usually recorded using audio mixing consoles to the extent that the recording relates to audio signals. In this context, any sound composition and/or any sound signal should be understood to be an acoustic scene. To account for the fact that the acoustic signal and/or sound or audio signal received by a listener and/or at a listening position typically comes from a plurality of different sources, the term 'acoustic scene' is used herein, wherein an acoustic scene as referred to herein may, of course, also be generated by merely a single source of sound. However, the character of such an acoustic scene is not only determined by the number and/or the distribution of the sources of sound in a space which generate the same, but also by the shape and/or geometry of the space itself. For example, reflections caused by partition walls are superposed on the sound portions directly reaching a listener from the source of sound as part of the room acoustics in enclosed spaces that, in simple terms, may be understood to be a temporally delayed and attenuated copy of the direct sound portions amongst others.

In such environments, an audio mixing console is often used to produce audio material which comprises a plurality of channels and/or inputs each of which is associated with one of many microphones which are again arranged within the acoustic scene, such as within a concert hall or the like. The individual audio and/or source signals may here be present in both analog and digital form, e.g., as a series of digital sample values, wherein the sample values are temporally equidistant and correspond each to an amplitude of the sampled audio signal. Depending on the audio signal used, such a mixing console may thus be implemented as, e.g., a dedicated hardware or as a software component on a PC and/or a programmable CPU provided that the audio signals are available in digital form. Electrical audio signals which may be processed using such audio mixing consoles may—except for microphones—also come from other playback devices, such as instruments and effect equipment or the like. In doing so, each single audio signal and/or each audio signal to be processed may be associated with a separate channel strip on the mixing console, wherein a channel strip may provide multiple functions concerning the tonal change of the associated audio signal, such as a change in volume, a filtering, a mixing with other channel strips, a distribution and/or a splitting of the relevant channel or the like.

When recording complex audio scenes, such as concert recordings, the problem is often to generate the audio signal and/or the mixed recording such that the sound impression as close to the original as possible is created for a listener when listening to the recording. Here, the so-called mixing of the initially recorded microphone signals and/or source signals for different reproduction configurations may need to take place differently, such as for different numbers at output channels and/or loudspeakers. Corresponding examples include a stereo configuration and multichannel configurations such as 4.0, 5.1 or the like. To be able to create such a spatial audio mixing and/or mixing, to date the volume is set for each source of sound and/or for each microphone and/or source signal at the respective channel strip such that the spatial impression desired by the sound engineer results for the listening configuration desired. This is mainly achieved by the volume being distributed between several playback channels and/or loudspeakers by so-called panning algorithms such that a phantom source of sound is created between the loudspeakers to achieve a spatial impression. This means, due to the different volumes for the individual playback channels, the listener is given the impression that, for example, the object reproduced is spatially located between the loudspeakers. To facilitate this, to date each channel has to be adjusted manually based on the real position of the recording microphone within the acoustic scene and has to be aligned with a partly considerable number of further microphones.

Such audio mixings become even more complicated and time-consuming and/or cost-intensive if the listener should be given the impression that the recorded source of sound is moving. In this case, the volume for all channel strips involved has to be readjusted manually for each of the temporally variable, spatial configurations and/or for each time step within the movement of a source of sound, something that is not only extremely time-consuming but also susceptible to errors.

In some scenarios, such as when recording a symphonic orchestra, a large number of microphone signals and/or source signals of, e.g., more than 100 is recorded simultaneously and is possibly processed in real-time to an audio mixing. To achieve such a spatial mixing, to date the operator and/or sound engineer has to generate, at least in the run-up to the actual recording the spatial relationship between the individual microphone signals and/or source signals on a conventional mixing console by initially taking a note of the positions of the microphones and their association with the individual channel strips by hand in order to control the volumes and possibly other parameters, such as a distribution of volumes for multiple channels or reverberation (pan and reverberation) of the individual channel strips such that the audio mixing has the desired spatial effect at the desired listening position and/or for a desired loudspeaker arrangement. In case of a symphonic orchestra with more than 100 instruments each of which is recorded separately as a direct source signal, this may be a problem which is almost impossible to solve. In order to reproduce a spatial arrangement of the recorded source signals of the microphones on the mixing console which is similar to reality following the recording, to date the positions of the microphones have been outlined by hand or their positions have been numbered in order to then be able to reproduce the spatial audio mixing in a time-consuming procedure by setting the volume of all individual channel strips. However, in case of a very large number of microphone signals to be recorded, it is not only the subsequent mixing of a successful recording which presents a big challenge.

Rather, in case of a large number of source signals to be recorded, it is already a problem difficult to solve to ensure that any and all microphone signals are delivered to the mixing console and/or a software used for audio mixing free from interference. To date, this has to be verified by the sound engineer and/or an operator of the mixing console listening and/or checking all channel strips separately, something that is very time-consuming and, if an interfering signal occurs of which the origin cannot immediately be located, may result in a time-consuming error search. When listening to and/or switching individual channels and/or source signals on/off, care must also be taken to ensure that the additional recordings, which associate the microphone signal and the position of the same with the channel of the mixing console during the recording, are error-free. This check alone may take several hours in case of large recordings, whereby it is subsequently difficult or no longer possible to compensate for errors made in the complex check, once the recording has been finalized.

BRIEF SUMMARY OF THE INVENTION

Thus, there is the need, when recording acoustic scenes using at least two microphones, to provide a concept that may facilitate making and/or mixing the recording more efficiently and with a smaller susceptibility to errors.

This problem is solved by a mixing console, an audio signal generator, a method and a computer program, each comprising the features of the independent claims. Favorable embodiments and developments are the object of the dependent claims.

Some embodiments of the present invention facilitate this, particularly by using an audio signal generator for providing an audio signal for a virtual listening position within a space, in which an acoustic scene is recorded by at least a first microphone at a first known position within the space as a first source signal and by at least a second microphone at a second known position within the space as a second source signal. To facilitate this, the audio signal generator comprises an input interface to receive the first and second source signals recorded by the first microphone and by the second microphone. A geometry processor within the audio signal generator is configured to determine a first piece of geometry information comprising a first distance between the first known position and the virtual listening position (202) based on the first position and the virtual listening position, and a second piece of geometry information comprising a second distance between the second known position and the virtual listening position (202) based on the second position and the virtual listening position so that the same may be taken into account by a signal generator which serves to provide the audio signal. For this purpose, the signal generator is configured to combine at least the first source signal and the second source signal according to a combination rule in order to obtain the audio signal. In this respect, the combination takes place using the first piece of geometry information and the second piece of geometry information according to the embodiments of the present invention. That is, according to the embodiments of the present invention, an audio signal, which may correspond or be similar to the spatial perception at the location of the virtual listening position, may be generated from two source signals, which are recorded by means of real microphones, for a virtual listening position at which no real microphone needs to be located in the acoustic scene to be mixed and/or recorded. In particular, this may, for example, be achieved by directly using geometry information which, for example, indicates the relative position between the positions of the real microphones and the virtual listening position in the provision and/or generation of the audio signal for the virtual listening position. Therefore, this may be possible without any time-consuming calculations so that the provision of the audio signal may take place in real-time or approximately in real-time.

The direct use of geometry information for generating an audio signal for a virtual listening position may furthermore facilitate creating an audio mixing by simply shifting and/or changing the position and/or the coordinates of the virtual listening position, without the possibly large number of source signals having to be adjusted individually and manually. Creating an individual audio mixing may, for example, also facilitate an efficient check of the set-up prior to the actual recording, wherein, for example, the recording quality and/or the arrangement of the real microphones in the scene may be checked by freely moving the virtual listening position within the acoustic scene and/or within the acoustic space so that a sound engineer may immediately obtain an automated acoustic feedback as to whether or not the individual microphones are wired correctly and/or whether or not the same work properly. For example, the functionality of each individual microphone may thus be verified without having to fade out all other microphones when the virtual listening position is guided close to the position of one of the real microphones so that its portion dominates at the audio signal provided. This again facilitates a check of the source signal and/or audio signal recorded by the relevant microphone.

Furthermore, embodiments of the invention may possibly facilitate, even if an error occurs during a live recording, intervening quickly and remedying the error, for example by exchanging a microphone or a cable, by quickly identifying the error such that an error-free recording of at least large parts of the concert is still possible.

According to the embodiments of the present invention, it may furthermore no longer be required to record and/or outline the position of a plurality of microphones, which are used to record an acoustic scene, independent from the source signals to subsequently reproduce the spatial arrangement of the recording microphones when mixing the signal which represents the acoustic scene. Rather, according to some embodiments, the predetermined positions of the microphones recording the source signals within the acoustic space may directly be taken into account as control parameters and/or feature of individual channel strips in an audio mixing console and may be preserved and/or recorded together with the source signal.

Some embodiments of the present invention are a mixing console for processing at least a first and a second source signal and for providing a mixed audio signal, the mixing console comprising an audio signal generator for providing an audio signal for a virtual listening position within a space in which an acoustic scene is recorded by at least a first microphone at a first known position within the space as the first source signal and by at least a second microphone at a second known position within the space as a second source signal, the audio signal generator comprising: an input interface configured to receive the first source signal recorded by the first microphone and the second source signal recorded by the second microphone; a geometry processor configured to determine a first piece of geometry information based on the first position and the virtual listening position and a second piece of geometry information based on the second position and the virtual listening position; and a signal generator for providing the audio signal, wherein the signal generator is configured to combine at least the first source signal and the second source signal according to a combination rule using the first piece of geometry information and the second piece of geometry information. This may enable an operator of a mixing console to perform a check, for example of the microphone cabling, prior to a recording in a simple, efficient manner and without a high probability of errors.

According to some embodiments, the mixing console further comprises a user interface configured to indicate a graphic representation of the positions of a plurality of microphones as well as one or several virtual listening positions. That is, some embodiments of mixing consoles furthermore allow it to graphically represent an image of the geometric ratios when recording the acoustic scene, something that may enable a sound engineer in a simple and intuitive manner to create a spatial mixing and/or check or build up and/or adjust a microphone set-up for recording a complex acoustic scene.

According to some further embodiments, a mixing console additionally comprises an input device configured to input and/or change at least the virtual listening position, in particular by directly interacting and/or influencing the graphic representation of the virtual listening position. This allows it in a particularly intuitive way to perform a check of individual listening positions and/or of microphones associated with these positions by, for example, the virtual listening position being able to be shifted within the acoustic scene and/or the acoustic space with the mouse or by means of the finger or a touch-sensitive screen (touchscreen) to the location of current interest.

Furthermore, some further embodiments of mixing consoles allow it to characterize each of the microphones as belonging to a specific one of several different microphone types via the input interface. In particular, a microphone type may correspond to microphones which mainly record a direct sound portion due to their geometric relative position with regard to the objects and/or sources of sound of the acoustic scene to be recorded. For the same reason, a second microphone type may primarily characterize microphones which record a diffuse sound portion. The option to associate the individual microphones with different types may, for example, serve to combine the source signals which are recorded by the different types with one another using different combinations rules in order to obtain the audio signal for the virtual listening position.

According to some embodiments, this may particularly be used to use different combination rules and/or superposition rules for microphones which mainly record diffuse sound and for such microphones which mainly record direct sound in order to arrive at a natural sound impression and/or a signal which comprises favorable features for the given requirement. According to some embodiments wherein the audio signal is generated by forming a weighted sum of at least a first and a second source signals, the weights are, for example, determined differently for different microphone types. For example, in microphones which mainly record direct sound, a decrease in volume which corresponds to reality may be implemented in this way with increasing distance from the microphone via a suitably selected weighting factor. According to some embodiments, the weight is proportional to the inverse of a power of the distance of the microphone to the virtual listening position. According to some embodiments, the weight is proportional to the inverse of the distance, something that corresponds to the sound propagation of an idealized point-shaped source of sound. According to some embodiments, for microphones associated with the first microphone type, i.e., the recording of direct sound, the weighting factors are proportional to the inverse of the distance of the microphone to the virtual listening position multiplied by a near-field radius. This may result in an improved perception of the audio signal by taking into account the assumed influence of a near-field radius within which a constant volume of the source signal is assumed.

According to some embodiments of the invention, the audio signal is also generated from the recorded source signals $x_1$ and $x_2$ for microphones, which are associated with a second microphone type and by means of which mainly diffuse sound portions are recorded, by calculating a weighted sum, wherein the weights $g_1$ and $g_2$ depend on the relative positions of the microphones and meet an additional boundary condition at the same time. In particular, according to some embodiments of the present invention, the sum of the weights $G=g_1+g_2$ or a square sum of weights $G2=g_1^2+g_2^2$ is constant and in particular is one. This may result in a combination of the source signals in which a volume of the generated audio signal for different relative positions between the microphones corresponds at least approximately to a volume of each of the source signals, something that may again result in a good perception quality of the generated audio signal as the diffuse signal portions within an acoustic space comprise approximately identical volumes.

According to some embodiments of the present invention, a first intermediate signal and a second intermediate signal are formed from the source signals initially by means of two weighted sums with different weights. Based on the first and second intermediate signals, the audio signal is then determined by means of a further weighted sum, wherein the weights are dependent on a correlation coefficient between the first and the second source signals. Depending on the similarity of the two recorded source signals, this may allow to combine combination rules and/or panning methods with one another, weighted such that excessive volume increases, as they may in principle occur depending on the selected method and the signals to be combined, may be further reduced. This may result in the total volume of the generated audio signal remaining approximately constant independent of the combined signal shapes so that the spatial impression given corresponds to what was desired, largely also without any a priori knowledge about the source signal.

According to some further embodiments, the audio signals—particularly as far as their diffuse sound portions are concerned—are formed using the three source signals in areas in which the virtual listening position is surrounded by three microphones each recording a source signal. Here, providing the audio signal comprises generating a weighted sum of the three recorded source signals. The microphones associated with the source signals form a triangle, wherein the weights are determined for a source signal based on a vertical projection of the virtual listening position onto such height of the triangle which runs through the position of the relevant microphone. Different methods may here be used to determine the weights. Nevertheless, the volume may remain approximately unchanged, even if three instead of only two source signals are combined, something that may contribute to a tonally more realistic reproduction of the sound field at the virtual listening position.

According to some embodiments of the present invention, either the first or the second source signal is delayed by a delay time prior to the combination of the two source signals if a comparison of the first piece of geometry information and the second piece of geometry information meets a predetermined criterion, particularly if the two distances deviate from one another by less than an operable minimum distance. This may allow to generate the audio signals without any sound colorations arising which might possibly be generated by the superposition of a signal which was recorded at a small spatial distance to one another. According to some embodiments, each of the source signals used is delayed particularly in an efficient manner such that its propagation time and/or latency corresponds to the maximum signal propagation time from the location of all microphones involved to the virtual listening position so that destructive interferences of similar or identical signals may be avoided by a forced identical signal propagation time.

According to some further embodiments, directional dependencies are further taken into account in the superposition and/or weighted summation of the source signals, i.e., a preferred direction and a directivity indicated with regard to the preferred direction may be associated with the virtual listening position. This may allow to achieve an effect close to reality when generating the audio signal by additionally taking into account a known directivity, such as of a real microphone or the human hearing.

BRIEF DESCRIPTION OF THE DRAWINGS

Embodiments of the present invention will be described in more detail in the following with reference to the accompanying figures, in which.

DETAILED DESCRIPTION OF THE INVENTION

Figure 1:
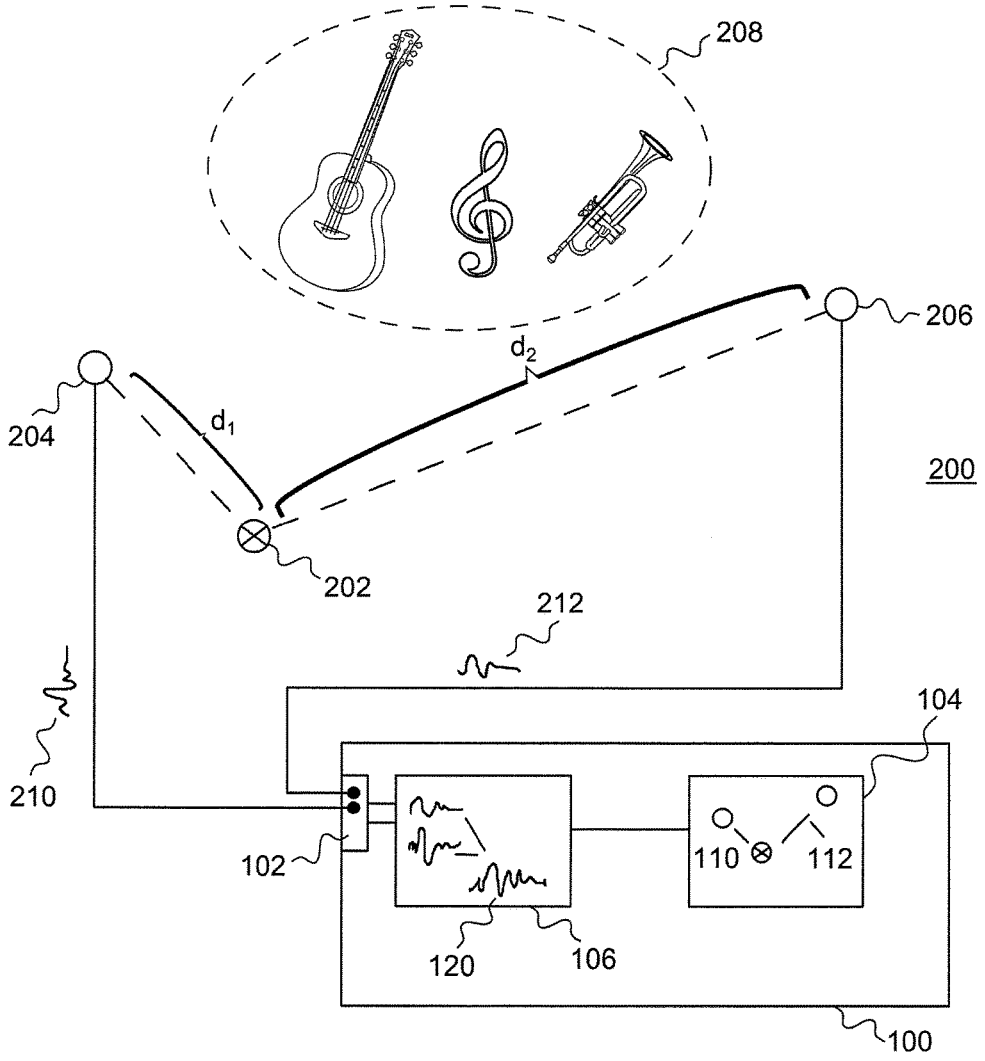
FIG. 1: shows an embodiment of an audio signal generator.

Various embodiments will now be described more fully with reference to the accompanying drawings in which some embodiments are illustrated. In the figures, the thicknesses of lines, layers and/or regions may be exaggerated for clarity.

In the following description of the accompanying figures, which merely show some exemplary embodiments, like reference numbers may refer to like or comparable components. Furthermore, summarizing reference numbers may be used for components and objects which occur several times in an embodiment or in a drawing, but are described jointly with regard to one or several features. Components or objects which are described using like or summarizing reference numbers may be realized in the same way—however, if necessary, also be implemented differently—with regard to individual, several or all features, such as their dimensionings.

Even though embodiments may be modified and amended in various ways, embodiments in the figures are represented as examples and are described in detail herein. However, it is made clear that it is not intended to limit embodiments to the particular forms disclosed, but on the contrary, embodiments should cover any and all functional and/or structural modified cations, equivalents, and alternatives falling within the scope of the invention. Like reference numbers refer to like or similar elements throughout the entire description of the figures.

It should be noted that, when an element is referred to as being "connected" or "coupled" to another element, it can be directly connected or coupled to the other element or intervening elements may be present. In contrast, when an element is referred to as being "directly connected" or "directly coupled" to another element, no intervening elements are present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to limit the embodiments. As used herein, the singular forms "a," "an" and "the" are intended to include the plural forms as well, unless the context clearly indicates otherwise. It is further made clear that the terms, e.g., "comprises," "comprising," "includes" and/or "including," as used herein, specify the presence of stated features, integers, steps, operations, elements and/or components, but do not preclude the presence or addition of one or more further features, integers, steps, operations, elements, components and/or groups thereof.

Unless defined otherwise, any and all terms (including technical and scientific terms) used herein have the same meaning as commonly understood by one of ordinary skill in the art to which embodiments belong. It is further made clear that terms, e.g., those defined in commonly used dictionaries, should be interpreted as having a meaning that is consistent with their meaning in the context of the relevant art and should not be interpreted in an idealized or overly formal sense unless expressly defined herein.

In a schematic representation, FIG. 1 shows an embodiment of an audio signal generator 100 comprising an input interface 102, a geometry processor 104 and a signal generator 106. The audio signal generator 100 serves to provide an audio signal for a virtual listening position 202 within a space 200 which is merely indicated schematically in FIG. 1. In the space 200, an acoustic scene is recorded using at least a first microphone 204 and a second microphone 206. The source 208 of the acoustic scene is here merely illustrated schematically as a region within the space 200 within which a plurality of sound sources are and/or may be arranged leading to a sound field within the space 200 that is referred to as an acoustic scene and is recorded by means of microphones 204 and 206.

The input interface 102 is configured to receive a first source signal 210 recorded by the first microphone 204 and a second source signal 212 recorded by the second microphone 206. The first and the second source signals 210 and 212 may here be both analog and digital signals which may be transmitted by the microphones in both encoded and unencoded form. That is, according to some embodiments, the source signals 210 and 212 may already be encoded and/or compressed according to a compression method, such as the Advanced Audio Codec (AAC), MPEG 1, Layer 3 (MP3) or the like.

The first and the second microphones 204 and 206 are located at predetermined positions within the space 200 which are also known to the geometry processor 104. Furthermore, the geometry processor 104 knows the position and/or the coordinates of the virtual listening position 202 and is configured to determine a first piece of geometry information 110 from the first position of the first microphone 204 and the virtual listening position 202. The geometry processor 104 is further configured to determine a second piece of geometry information 112 from the second position and the virtual listening position 202.

While not claiming to be exhaustive, an example for such a piece of geometry information is a distance between the first position and the virtual listening position 202 or a relative orientation between a preferred direction associated with the virtual listening position 202 and a position of one of the microphones 204 or 206. Of course, the geometry may also be described in any way, such as by means of Cartesian coordinates, spherical coordinates or cylindrical coordinates in a one-, two- or three-dimensional space. In other words, the first piece of geometry information may comprise a first distance between the first known position and the virtual listening position, and the second piece of geometry information may comprise a second distance between the second known position and the virtual listening position.

The signal generator is configured to provide the audio signal combining the first source signal 210 and the second source signal 212, wherein the combination follows a combination rule according to which both the first piece of geometry information 110 and the second piece of geometry information 112 are taken into account and/or used.

Thus, the audio signal 120 is derived from the first and the second source signals 210 and 212, wherein the first and the second pieces of geometry information 110 and/or 112 are used here. That is, information about the geometric characteristics and/or relationships between the virtual listening position 12 and the positions of the microphones 204 and 206 are directly used to determine the audio signal 120.

By varying the virtual listening position 202, it may thus be possible in a simple and intuitive manner to obtain an audio signal which allows for a check of the functionality of the microphones arranged close to the virtual listening position 202 without, for example, the plurality of microphones within an orchestra having to be listened to individually via the channels of a mixing console respectively associated with the same.

According to the embodiments in which the first piece of geometry information and the second piece of geometry information comprise at least as one piece of information the first distance $d_1$ between the virtual listening position 202 and the first position and the second distance $d_2$ between the virtual listening position 202 and the second position, a weighted sum of the first source signal 210 and the second source signal 212, amongst others, is used for generating the audio signal 120.

Although, merely two microphones 204 and 206 are illustrated in FIG. 1 for the sake of simplicity and for a better understanding, it goes without saying that, according to further embodiments of the present invention, any number of microphones of the kind schematically illustrated in FIG. 1 may be used by an audio signal generator 100 to generate an audio signal for a virtual listening position as it will be explained here and using the following embodiments.

That is, according to some embodiments, the audio signal x is generated from a linear combination of the first source signal 210 ($x_1$) and the second source signal ($x_2$), wherein the first source signal $x_1$ is weighted by a first weight $g_1$ and the second source signal $x_2$ is weighted by a second weight $g_2$ so that the following applies:

$$x=g_1*x_1+g_2*x_2.$$

According to some embodiments, further source signals $x_3, \ldots, x_n$ as already mentioned with corresponding weights $g_3, \ldots, g_n$ may also be taken into account. Of course, audio signals are time-dependent, wherein, in the present case, it is partly refrained from making explicit reference to a time dependence for reasons of clarity, and information provided on audio signals or source signals x is to be understood to be synonymous with the information x(t).

Figure 2:
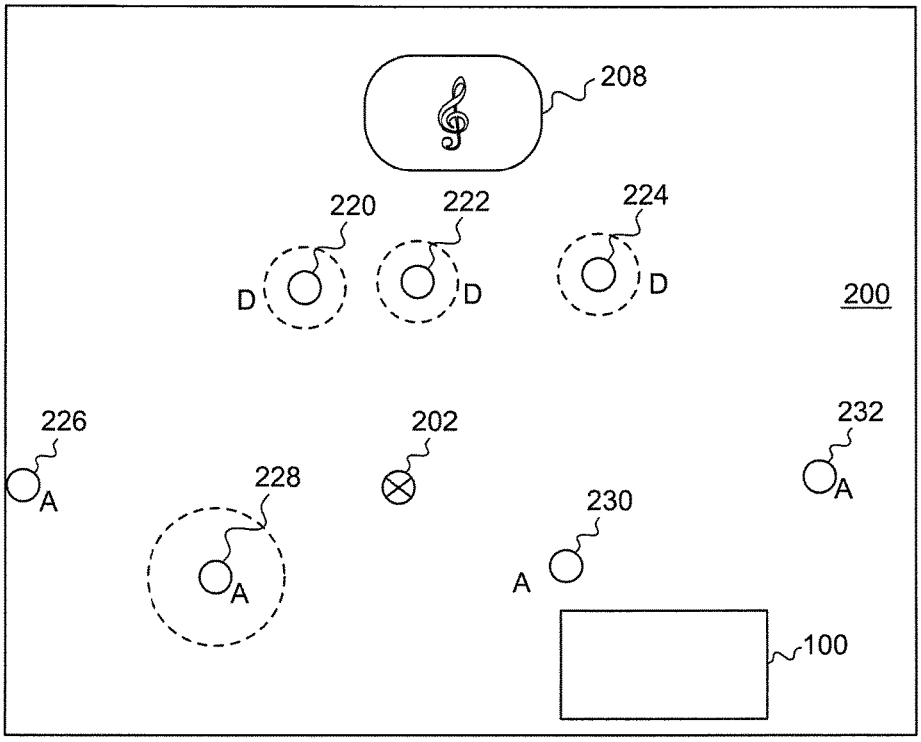
FIG. 2: shows an illustration of an acoustic scene of which the source signals are processed with embodiments of audio signal generators.

FIG. 2 shows schematically the space 200, wherein it is assumed in the illustration opted for in FIG. 2 that the same is limited by rectangular walls which are responsible for the occurrence of a diffuse sound field. Furthermore, it is assumed in simple terms that, even though one or several sound sources may be arranged within the confined area in the source 208 illustrated in FIG. 2, the same may, initially in a simplified form, be considered to be a single source with regard to their effect for the individual microphones. The direct sound radiated by such sound sources is reflected multiple times by the walls which limit the space 200 so that a diffuse sound field generated by the multiple reflections of the already attenuated signals results from signals superposed in an uncorrelated manner, and that features a constant volume at least approximately within the entire space. A direct sound portion is superposed on the same, i.e., such sound which directly reaches the possible listening positions, including particularly the microphones 220 and 232, from the sound sources located within the source 208 without having been reflected before. That is, the sound field may be differentiated into two components within the space 200 in a conceptually idealized sense, i.e., a direct sound portion which directly reaches the corresponding listening position from the place of generation of the sound, and a diffuse sound portion which comes from an approximately uncorrelated superposition of a plurality of directly radiated and reflected signals.

In the illustration shown in FIG. 2, it may be assumed due to the spatial proximity of the microphones 220 to 224 to the source 208 that they mainly record direct sound, i.e., the volume and/or the sound pressure of the signal recorded by these microphones mainly comes from a direct sound portion, the sound sources arranged within the source 208. In contrast, it may, for example, be assumed that the microphones 226 to 232 record a signal which mainly comes from the diffuse sound portion as the spatial distance between the source 208 and the microphones 226 to 232 is large so that the volume of the direct sound at these positions is at least comparable to, or smaller than, the volume of the diffuse sound field.

Figure 3:
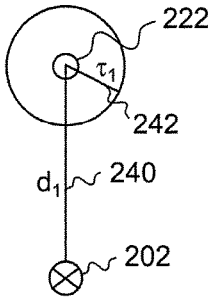
FIG. 3: shows an example for a combination rule for generating an audio signal according to some embodiments of the invention.

To account for the reduction in volume with increasing distance in the generation of the audio signal for the virtual listening position 202, according to some embodiments of the invention, a weight $g_n$ is selected for the individual source signals depending on the distance between the virtual listening position 202 and the used microphones 220 to 232 for recording the source signals. FIG. 3 shows an example of a way to determine such a weight and/or such a factor for multiplication by the source signal, wherein the microphone 222 was selected here as an example. As is schematically illustrated in FIG. 3, the weight $g_n$ is selected proportional to the inverse of a power of the first distance $d_1$ in some embodiments, i.e.:

$$g_1 \propto \frac{1}{d_1^n}.$$

According to some embodiments, n=1 is selected as a power, i.e., the weight and/or the weight factor is inversely proportional to the distance $d_1$, a dependence which roughly corresponds to the free field propagation of a uniformly radiating point-shaped sound source. That is, it is assumed according to some embodiments that the volume is inversely proportional to the distance 240. According to some further embodiments, a so-called near-field radius 242 ($r_1$) is additionally taken into account for some or for all of the microphones 220 to 232. The near-field radius 242 corresponds here to an area directly around a sound source, particularly to an area within which the sound wave and/or the sound front is formed. Within the near-field radius, the sound pressure level and/or the volume of the audio signal is assumed to be constant. In this respect, it may be assumed in a simple model representation that no significant attenuation arises in the medium within a single wave length of an audio signal so that the sound pressure is constant at least within a single wave length (corresponding to the near-field radius). This means that the near-field radius may also be frequency-dependent.

By using the near-field radius in an analog manner according to some embodiments of the invention, an audio signal may be generated at the virtual listening position 202 by particularly clearly weighting the quantities relevant for checking the acoustic scene and/or the configuration and cabling of the individual microphones if the virtual listening position 202 approaches one of the real positions of the microphones 220 to 232. Even though a frequency-independent quantity is assumed for the near-field radius r according to some embodiments of the present invention, a frequency dependence of the near-field radius may be implemented according to some further embodiments. According to some embodiments, it is thus assumed for generation of the audio signal that the volume is constant around one of the microphones 220 to 232 within a near-field radius r. To simplify the calculation of the signal and to, possibly, nevertheless account for the influence of a near-field radius, it is assumed as a general calculation rule according to some further embodiments that the weight $g_1$ is proportional to a quotient of the near-field radius $r_1$ of the microphone 222 considered and the distance $d_1$ of virtual listening position 202 and microphone 222, so that the following applies:

$$g_1 \propto \frac{r_1}{d_1^n}.$$

Such a parameterization and/or dependence on distance may account for both the considerations concerning the near field and the considerations concerning the far field. As mentioned above, a near field of a point-shaped sound source is adjacent to a far field in which, in case of a free field propagation, the sound pressure is halved with each doubling of the distance from the sound source, i.e., the level is reduced by 6 dB in each case. This characteristic is also known as distance law and/or 1/r law. Even though, according to some embodiments of the invention, sources 208 may be recorded of which the sound sources radiate directionally, point-shaped sound sources may possibly be assumed if the focus is not on a real-world reproduction of the sound field at the location of the virtual listening position 202, but rather on the possibility to check and/or listen to the microphones and/or the recording quality of a complex acoustic scene in a fast and efficient way.

As already indicated in FIG. 2, the near-field radii for different microphones may be selected differently according to some embodiments. In particular, the different microphones types may be accounted for here. A piece of information that, independent of the actual set-up of the individual microphone, describes a characteristic of the microphone or its use which differs from an identical characteristic or use of a further microphone, which is also used to record the source 208, should herein be understood to be a microphone type. An example for such a distinction is the distinction between microphones of a first type (type "D" in FIG. 2) which, due to their geometric positioning, mainly record direct sound portions, and such microphones which, due to the greater distance and/or another relative position with regard to the source 208 mainly record and/or register the diffuse sound field (type "A" microphones in FIG. 2). In particular in such a differentiation of microphones in different types of microphones, the use of different near-field radii may be useful. According to some embodiments, the near-field radius of the type A microphones is here selected to be larger than the same for the type D microphones, which may lead to a simple possibility of checking the individual microphones if the virtual listening position 202 is placed in their proximity without grossly distorting the physical conditions and/or the sound impression, particularly as the diffuse sound field as illustrated above is approximately equally loud across large areas.

In general terms, according to some embodiments of the present invention, audio signal generators 100 use different combination rules for combining the source signals if the microphones which record the respective source signals are associated with different microphone types. That is, a first combination rule is used if the two microphones to be combined are associated with a first microphone type, and a second combination rule is used if the two microphones to be combined and/or the source signals recorded by these microphones are associated with a second different microphone type.

In particular, according to some embodiments, the microphones of each different type may initially be processed entirely separated from one another and may each be combined to one partial signal $x_{virt}$, whereupon, in a final step, the final signal is generated by the audio signal generator and/or a mixing console used by combining the previously generated partial signals. Applying this to the acoustic scene illustrated in FIG. 2, this means, for example, that a partial signal $x_A$ may initially be determined for the virtual listening 202 which merely takes into account the type A microphones 226 to 232. Simultaneously or before and/or after that, a second partial signal $x_D$ might be determined for the virtual listening position 202 which merely takes into account the type D microphones, i.e., the microphones 220 to 224, but combines the same with one another according to another combination rule. In a final step, the final audio signal x might then be generated for the virtual listening position 202 by combining these two partial signals, particularly by way of a linear combination of the first partial signal $x_D$ which was derived by means of the microphones of the first type (D) and of the second partial signal $x_A$ which was derived by means of the microphones of the second type (A) so that the following applies:

$$x=x_A+x_D.$$

Figure 4:
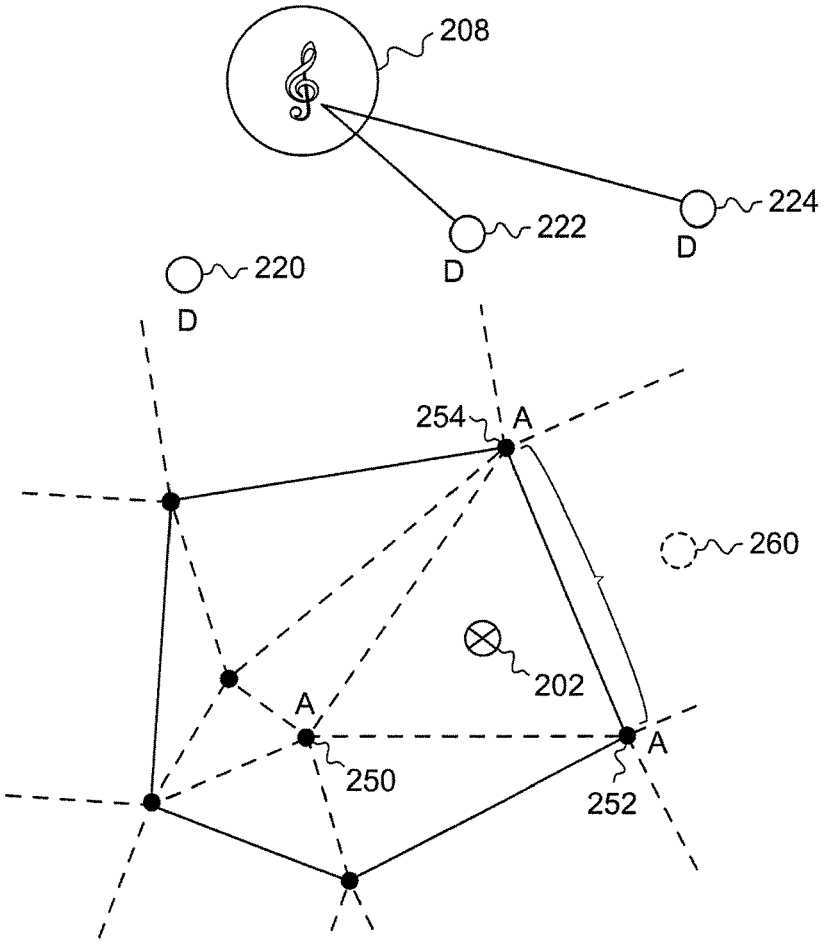
FIG. 4: shows an illustration for clarifying a further example of a possible combination rule.

FIG. 4 shows a schematic view of an acoustic scene similar to FIG. 2, together with positions of microphones 220 to 224 which record direct sound, and a number of type A microphones of which subsequently the microphones 250 to 256 in particular are to be considered. In this respect, some options are discussed as to with which combination rules an audio signal may be generated for the virtual listening position 202 which is arranged within a triangular surface spanned by the microphones 250 to 254 in the configuration illustrated in FIGS. 4 and 5.

In general terms, the interpolation of the volume and/or generating the audio signal for the virtual listening position 202 may take place taking into account the positions of the nearest microphones or taking into account the positions of all microphones. For example, it may be favorable, for reducing the computing load amongst others, to merely use the nearest microphones for generating the audio signal at the virtual listening position 202. The same may, for example, be found by means of a Delaunay triangulation and/or by any other algorithms for searching the nearest neighbor. Some special options to determine the volume adjustment, or, in general terms, to combine the source signals which are associated with the microphones 250 to 254 are hereinafter described, particularly in reference to FIG. 5.

If the virtual listening position 202 were not located within one of the triangulation triangles, but outside of the same, e.g., at the further virtual listening position 260 drawn as a dotted line in FIG. 4, merely two source signals of the next neighbors would be available for interpolation of the signal and/or for combination of an audio signal from the source signals of the microphones. For the sake of simplicity, the option to combine two source signals is hereinafter also discussed using FIG. 5, wherein the source signal of the microphone 250 is initially neglected in the interpolation from two source signals.

According to some embodiments of the invention, the audio signal for the virtual listening position 202 is generated according to a first crossfade rule, the so-called linear panning law. According to this method, the audio signal $x_{virt1}$ is determined using the following calculation rule:

$$x_{virt1}=g_1*x_1+(1-g_1)*x_2, \text{ wherein } g_2=(1-g_1).$$

That is, the weights of the individual source signals $x_1$ and $x_2$ to be added add linearly up to 1, and the audio signal $x_{virt1}$ is formed either by one of the two signals $x_1$ or $x_2$ alone or by a linear combination of both of them. Due to this linear relation, the audio signals generated in this way comprise a constant volume for any values of $g_1$ in identical source signals, whereas entirely different (decorrelated) source signals $x_1$ and $x_2$ result in an audio signal which comprises a decrease in volume of minus 3 dB, i.e., by a factor of 0.5, for the value $g_1=0.5$.

A second crossfade rule according to which the audio signal $x_{virt2}$ may be generated is the so-called law of sines and cosines:

$$x_{virt2}=\cos(\delta)*x_1+\sin(\delta)*x_2, \text{ wherein } \delta\epsilon[0°;90°].$$

The parameter δ which determines the individual weights $g_1$ and $g_2$, reaches from 0° to 90° and is calculated from the distance between the virtual listening position 202 and the microphones 252 and 254. As the squares of the weights add up to 1 for any values of δ, an audio signal having a constant volume may be generated for any parameter δ by means of the law of sines and cosines if the source signals are decorrelated. However, in identical source signals, an increase in volume of 3 dB results for the parameter δ=45°.

A third crossfade rule which leads to the results similar to the second crossfade rule and according to which the audio signal $x_{virt3}$ may be generated is the so-called law of tangents:

$$x_{virt3} = g_1 * x_1 + g_2 * x_2,$$

$$\text{wherein } \frac{\tan\theta}{\tan\theta_0} = \frac{g_1 - g_2}{g_1 + g_2}$$

$$\text{and } \theta \in [0°; 90°].$$

A fourth crossfade rule which may be used to generate the audio signal $x_{virt4}$ is the so-called law of sines:

$$x_{virt4} = g_1 * x_1 + g_2 * x_2,$$

$$\text{wherein } \frac{\sin\theta}{\sin\theta_0} = \frac{g_1 - g_2}{g_1 + g_2}$$

$$\text{and } \theta \in [0°; 90°].$$

In this respect, too, the squares of the weights add up to 1 for any possible value of the parameter θ. The parameter θ is again determined by the distances between the virtual listening position 202 and the microphones; it may take on any value from minus 45 degrees to 45 degrees.

Particularly for the combination of two source signals regarding which there is only limited a priori knowledge—as it may, for example, be the case in a spatially slightly varying diffuse sound field—, a fourth combination rule may be used according to which the first crossfade rule described above and the second crossfade rule described above are combined depending on the source signals to be combined. In particular, according to the fourth combination rule, a linear combination of two intermediate signals $x_{virt1}$ and $x_{virt2}$ is used which were, each initially separately, generated for the source signals $x_1$ and $x_2$ according to the first and the second crossfade rules. In particular, according to some embodiments of the present invention, the correlation coefficient $\sigma_{x_1x_2}$ between the source signals $x_1$ and $x_2$ is used as a weight factor for the linear combination and that is defined as follows and presents a measure for the similarity of the two signals:

$$\sigma_{x_1x_2} = \frac{E\{(x_1 - E\{x_1\}) * (x_2 - E\{x_2\})\}}{\sigma_{x_1}\sigma_{x_2}} \approx \frac{E(x_1 * x_2)}{\sigma_{x_1}\sigma_{x_2}}.$$

Wherein E refers to the expectation value and/or the linear mean value and σ indicates the standard deviation of the relevant quantity and/or the relevant source signal, wherein it applies for acoustic signals in a good approximation that the linear mean value E[x] is zero.

$$x_{virt}=\sigma_{x1x2}*x_{virt1}+(1-\sigma_{x1x2})*x_{virt2}.$$

That is, according to some embodiments of the present invention, the combination rule further comprises forming a weighted sum $x_{virt}$ from the intermediate signals $x_{virt1}$ and $x_{virt2}$ weighted by a correlation coefficient $\sigma_{x_1x_2}$ for a correlation between the first source signal $x_1$ and the second source signal $x_2$.

By using the fourth combination rule, a combination having an approximately constant volume may thus be achieved across the entire parameter range according to some embodiments of the present invention. Furthermore, this may be achieved mainly irrespective of whether the signals to be combined are dissimilar or similar.

If, according to some embodiments of the present invention, an audio signal should be derived at a virtual listening position 202 which is located within a triangle limited by three microphones 250 to 254, the three source signals of the microphones 250 to 254 may be combined in a linear way according to some embodiments of the present invention, wherein the individual signal portions of the source signals associated with the microphones 250 to 254 are derived based on a vertical projection of the virtual listening position 202 onto such height of the triangle which is associated with the position of the microphone associated with the respective source signal.

If, for example, the signal portion of the microphone 250 and/or the weight associated with this source signal should be determined, a vertical projection of the virtual listening position 202 is initially performed on to the height 262 which is associated with the microphone 250 and/or the corner of the triangle at which the microphone 250 is located. This results in the projected position 264 illustrated as a dotted line in FIG. 5 on the height 262. The same in turn splits the height 262 into a first height section 226 facing the microphone 250 and a height section 268 facing away from the same. The ratio of these height sections 266 and 268 is used to calculate a weight for the source signal of the microphone 250 according to one of the above crossfade rules, wherein it is assumed that a sound source and/or a microphone is located at the end of the height 262 opposite to the microphone 250 and that constantly records a signal having the amplitude zero.

That is, according to the embodiments of the invention, the height of each side of the triangle is calculated and the distance of the virtual microphone to each side of the triangle is determined. Along the corresponding height, the microphone signal is faded to zero from the corner of the triangle to the opposite side of the triangle, in a linear way and/or depending on the selected crossfade rule. This means for the embodiment shown in FIG. 5 that the source signal of the microphone 250 is used having the weight 1 if the projection 264 is located at the position of the microphone 250, and having zero if the same is located on the connecting straight line between the position of the microphones 252 and 254, i.e., on the opposite side of the triangle. The source signal of the microphone 250 is faded in and/or faded out between these two extreme positions. Generally speaking, this means that, when combining the signal from three signals, three source signals $x_1$ to $x_3$ are taken into account of which the associated microphones 250 to 254 span a triangular surface within which the virtual listening position 202 is located. In this respect, the weights $g_1$ to $g_3$ are determined for the linear combination of the source signals $x_1$ to $x_3$ based on a vertical projection of the virtual listening position 202 onto such height of the triangle which is associated with the position of the microphone associated with the respective source signal and/or through which this height runs.

If the fourth crossfade rule discussed above is used to determine the signal, a joint correlation coefficient may be determined for the three source signals $x_1$ to $x_3$ by initially determining a correlation between the respective neighboring source signals from which three correlation coefficients result in total. From the three correlation coefficients obtained in this way, a joint correlation coefficient is calculated by determining a mean value, which again determines the weighting for the sum of partial signals formed by means of the first crossfade rule (linear panning) and the second crossfade rule (law of sines and cosines). That is, a first partial signal is initially determined using the law of sines and cosines, then a second partial signal is determined using the linear panning, and the two partial signals are combined in a linear way by weighting by the correlation coefficient.

Figure 6:
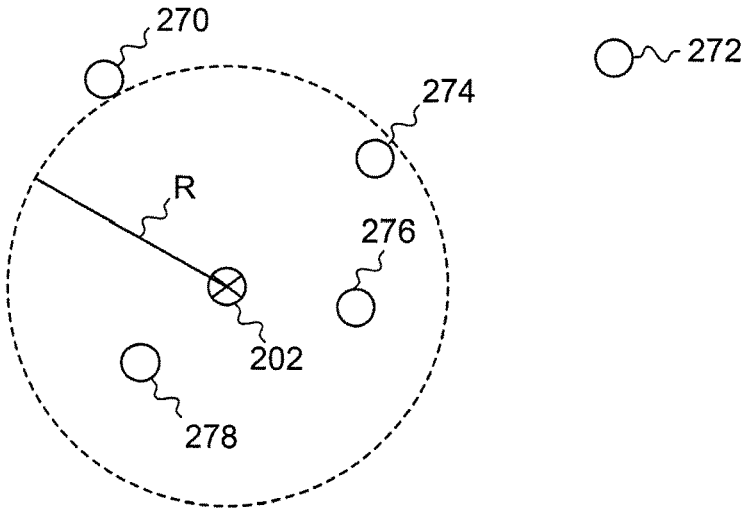
FIG. 6: shows an illustration of a further combination rule.

FIG. 6 shows an illustration of a further possible configuration of positions of microphones 270 to 278 within which a virtual listening position 202 is arranged. In particular by means of FIG. 6, a further possible combination rule is illustrated of which the characteristics may be combined in any way using the combination options described above, or which—even considered on its own—may be a combination rule as described herein.

According to some embodiments of the invention, a source signal as schematically illustrated in FIG. 6 is only taken into account in the combination for the audio signal for a virtual listening position 202 if the microphone associated with the source signal is located within a predetermined configurable distance R from the virtual listening position 202. According to some embodiments, computing time may thus possibly be saved by, for example, only taking into account those microphones of which the signal contributions are above the human hearing threshold according to the combination rules selected.

Figure 7:
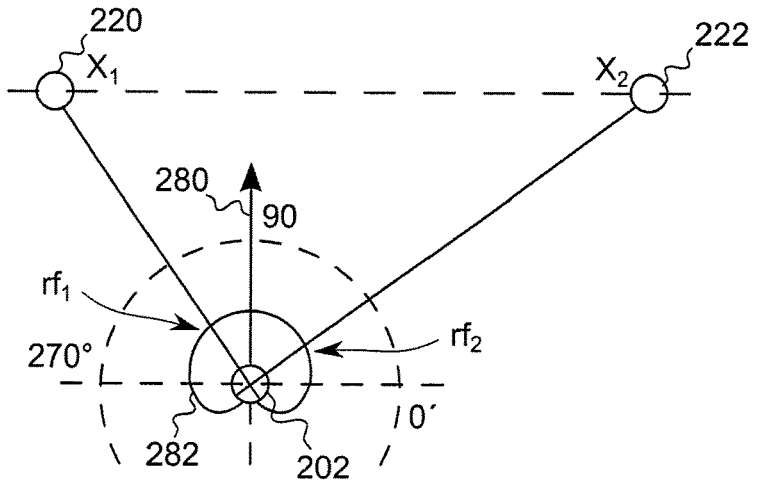
FIG. 7: shows an illustration of a direction-dependent combination rule.

According to some embodiments of the invention, the combination rule may, as schematically illustrated in FIG. 7, further take into account a directivity for the virtual listening position 202. That means, for example, that the first weight $g_1$ for the first source signal $x_1$ of the first microphone 220 may additionally be proportional to a directional factor $rf_1$ which results from a sensitivity function and/or a directivity for the virtual listening position 202, and from the relative position between virtual listening position 202 and microphone 220. That is, according to these embodiments, the first piece of geometry information further comprises a first piece of directional information about a direction between the microphone 220 and a preferred direction 280 associated with the virtual listening position 202 in which the directivity 282 comprises its maximum sensitivity.

Generally speaking, according to some embodiments, the weighting factors $g_1$ and $g_2$ of the linear combination of the source signals $x_1$ and $x_2$ are thus also dependent on a first directional factor $rf_1$ and a second directional factor $rf_2$ which account for the directivity 280 at the virtual listening position 202.

In other words, the combination rules discussed in the preceding paragraphs may be summarized as follows. The individual implementations are described in more detail in the following paragraphs. All variants have in common that comb filter effects might occur when adding up the signals. If this is potentially the case, the signals before that may be delayed accordingly. Therefore, the algorithm used for the delay is initially illustrated.

In microphones of which the distance to one another is greater than two meters, signals may be added up without any perceptible comb filter effects arising. Signals from microphones may also be added up without hesitation, wherein regarding their position distances the so-called 3:1 rule is met. The rule says that, when recording a sound source using two microphones, the distance between the sound source and the second microphone should at least be three times the distance from the sound source to the first microphone in order not to obtain any perceptible comb filter effects. Prerequisite to this are microphones of equal sensitivity and the decrease in sound pressure level with an increasing distance, e.g. pursuant to the 1/r law.

The system and/or an audio signal generator or its geometry processor initially identifies as to whether or not both conditions are met. If this is not the case, the signals may be delayed prior to the calculation of the virtual microphone signal according to the current position of the virtual microphone. For this purpose, the distances of all microphones to the virtual microphone are, if appropriate, determined and the signals are temporarily delayed with regard to the microphone which is located the furthest away from the virtual one. For this purpose, the largest distance is calculated and the difference to the remaining distances is calculated. The latency $\Delta t_i$ in samples now results from the ratio of the respective distance $d_i$ to the sound velocity c multiplied by the sampling rate Fs. The calculated value may, for example, be rounded in digital implementations if the signal should only be delayed by entire samples. N refers hereinafter to the number of recording microphones:

$$\Delta t_i = \text{round}\left(\frac{d_i}{c} * Fs\right) \text{ with} = 1, \ldots, N.$$

According to some further embodiments, the maximum latency determined is applied to all source signals.

To calculate the virtual microphone signal, the following variants may be implemented. In this respect, close microphones and/or microphones for recording direct sound are hereinafter referred to as microphones of a first microphone type, and ambient microphones and/or microphones for recording a diffuse sound portion are hereinafter referred to as microphones of a second microphone type. Furthermore, the virtual listening position is also referred to as position of a virtual microphone.

According to a first variant, both the signals of the close microphones and/or microphones of a first microphone type and the signals of the ambient microphones fall according to the distance law. As a result, each microphone may be audible in a particularly dominant way at its position. For the calculation of the virtual microphone signal, the near-field radii around the close and ambient microphones may initially be determined by the user. Within this radius, the volume of the signals remains constant. If the virtual microphone is now placed in the recording scene, the distances from the virtual microphone to each individual real microphone are calculated. For this purpose, the sample values of the microphone signals $x_i[t]$ are divided by the current distance $d_i$ and are multiplied by the near-field radius $r_{nah}$ [nah=near]. N indicates the number of recording microphones:

$$x_{i,gedämpft}(t) = \frac{x_i[t]}{d_i} * r_{nah} \; mit \; i = 1, \ldots, N.$$

[gedämpft = attenuated; *mit* = with]

Thus, the microphone signal $x_{i,gedämpft}$ attenuated due to the spatial distance $d_i$ is obtained. All signals calculated in this way are added up and form together the signal for the virtual microphone:

$$x_{virtMic}(t) = \Sigma_{i=1}^{N} x_{i,gedämpft}(t).$$

According to a second variant, the direct sound and the diffuse sound are separated. The diffuse sound field should have here approximately the same volume in the entire space. For this purpose, the space is divided into specific areas by the arrangement of the ambient microphones. Depending on the area, the diffuse sound portion is calculated from one, two or three microphone signals. The signals of the near microphones fall with increasing distance pursuant to the distance law.

FIG. 4 shows an example of a spatial distribution. The points symbolize the ambient microphones. The ambient microphones form a polygon. The area within this polygon is divided into triangles. For this purpose, the Delaunay triangulation is applied. Using this method, a triangle mesh may be formed from a point set. Its most essential characteristic is that the circumcircle of a triangle does not include any further points from the set. By meeting this so-called circumcircle condition, triangles are created having the largest interior angles possible. In FIG. 4, this triangulation is illustrated using four points.

Using the Delaunay triangulation, microphones located closely together are grouped and each microphone is mapped onto the surrounding space. The signal for the virtual microphone is calculated within the polygon from three microphone signals in each case. Outside of the polygon, two vertical straight lines which run through the corners are determined for each connecting line of two corners. Thus, specific areas outside the polygon are limited as well. Therefore, the virtual microphone may be located either between two microphones or, at one corner close to a microphone.

To calculate the diffuse sound portion, it should initially be determined as to whether the virtual microphone is located inside or outside of the polygon forming the edge. Depending on the position, the diffuse portion of the virtual microphone signal is calculated from one, two or three microphone signals.

If the virtual microphone is located outside the polygon, a distinction is made between the areas at one corner and between two microphones. If the virtual microphone is located at one corner of the polygon in the area close to a microphone, only the signal $x_i$ of this microphone is used for the calculation of the diffuse sound portion:

$$x_{diffus}[t] = x_i[t].$$

In the area between two microphones, the virtual microphone signal consists of the two corresponding microphone signals $x_1$ and $x_2$. Depending on the position, crossfading between the two signals takes place using various crossfade rules and/or panning methods. The same are hereinafter also referred to as: linear panning law (first crossfade rule), law of sines and cosines (second crossfade rule), law of tangents (third crossfade rule) and combination of linear panning law and law of sines and cosines (fourth crossfade rule).

For the combination of the two panning methods of linear law ($x_{virt1}$) and law of sines and cosines ($x_{virt2}$), the correlation coefficient $\sigma_{x_1x_2}$ of the two signals $x_1$ and $x_2$ is determined:

$$\sigma_{x_1x_2} = \frac{E\{(x_1 - E\{x_1\}) * (x_2 - E\{x_2\})\}}{\sigma_{x_1}\sigma_{x_2}} \approx \frac{E(x_1 * x_2)}{\sigma_{x_1}\sigma_{x_2}}$$

Depending on the size of the coefficient $\sigma_{x_1x_2}$, the respective law is included into the calculation of the weighted sum $x_{virt}$:

$$x_{virt}=\sigma_{x1x2}*x_{virt1}+(1-\sigma_{x1x2})*x_{virt2}, \text{ wherein}$$

$x_{virt1}=g_1*x_1+(1-g_1)*x_2$, wherein $g_2=(1-g_1)$; "linear panning"

$x_{virt2}=\cos(\delta)*x_1+\sin(\delta)*x_2$, wherein $\delta\epsilon[0°;90°]$; "law of sines and cosines".

If the correlation coefficient $\sigma_{x_1x_2}$ equals 1, it refers to identical signals and only linear crossfading takes place. If the correlation coefficient is 0, only the law of sines and cosines is applied.

In some implementations, the correlation coefficient may not only describe an instantaneous value, but may be integrated over a certain period. In the correlation protractor, this period may, for example, be 0.5 s. The correlation coefficient may also be determined over a longer period of time, e.g. 30 s, as the embodiments of the invention and/or the virtual microphones do not always need to be real-time capable systems.

Figure 5:
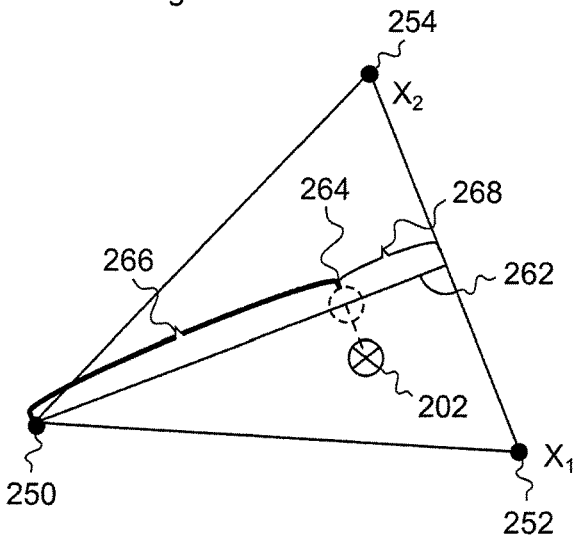
FIG. 5: shows a graphic illustration of a combination rule for use with three source signals.

In the area within the polygon, the virtual listening position is located within triangles of which the corners were determined using Delaunay triangulation as was shown using FIG. 5. In each triangle, the diffuse sound portion of the virtual microphone signal consists of the three source signals of the microphones located at the corners. For this purpose, the height h of each side of the triangle is determined and the distance $d_{virtMic}$ of the virtual microphone to each side of the triangle is determined. Along the corresponding height, the microphone signal is faded to zero from one corner to the opposite side of the triangle, depending on the panning method set and/or depending on the crossfade rule used.

In principle, the panning methods described above may be used for this which are also used for the calculation of the signal outside of the polygon. Dividing the distance $d_{virtMic}$ by the value of the height h normalizes the path to a length of 1 and provides the corresponding position on the panning curve. The value on the Y-axis can now be read off with which each of the three signals is multiplied according to the panning method set.

For the combination of linear panning law and the law of sines and cosines, the correlation coefficient is initially determined in each case from two source signals. As a result, three correlation coefficients are obtained from which the mean value is subsequently calculated.

This mean value determines the weighting of the sum of linear law and the panning law of sines and cosines. The following also applies here: If the value equals 1, crossfading only takes place using the linear panning law. If a value equals 0, only the law of sines and cosines is used. Finally, when added up all three signals produce the diffuse portion of the sound.

The portion of the direct sound is superposed on the diffuse one, wherein the direct sound portion of type "D" microphones and the indirect sound portion of type "A" microphones are recorded according to the previously introduced meaning. Eventually, the diffuse and the direct sound portions are added up and thus produce the signal for the virtual microphone:

$$x_{virtMic}[t]=x_{diffus}[t]+x_{direkt}[t].$$

It is furthermore possible to extend this variant. As required, a radius of any size may be set around a microphone. Within this area, only the microphone located there can be heard. All other microphones are set to zero and/or are allocated a weight of 0 so that the signal of the virtual microphone corresponds to the signal of the selected microphone:

$$x_{virtMic}[t]=x_{i,sel}[t].$$

According to the third variant, the microphones which are located within a specific surrounding around the virtual microphone are included in the calculation of the virtual microphone. For this purpose, the distances of all microphones to the virtual microphone are initially determined and, from this, it is determined which microphones are within the circle. The signals of the microphones which are outside the circle are set to zero and/or are allocate the weight 0.

The signal values of the microphones $x_i(t)$ within the circle are added up in equal parts and thus result in the signal for the virtual microphone. If N indicates the number of recording microphones within the circle, the following applies:

$$x_{virtMic}(t)=\frac{1}{N}\sum_{i=1}^{N}x_i(t).$$

To avoid suddenly occurring jumps in volume in the transition of a microphone in or out of the circle, the signals may additionally be faded in and/or faded out in a linear way at the edge of the circle. In this variant, no distinction needs to be made in close and ambient microphones.

In all variants, it may also be reasonable to associate an additional directivity with the virtual microphone. For this purpose, the virtual microphone may be provided with a direction vector r which, at the beginning, points into the main direction of the directivity (in the polar diagram). As the directivity of a microphone may only be effective for direct sound in some embodiments, the directivity then only impacts the signals of the close microphones. The signals of the ambient microphones continue to be included unchanged into the calculation according to the combination rule. Based on the virtual microphone, vectors are formed to all close microphones. For each of the close microphones, the angle $\varphi_{i,nah}$ is calculated between this vector and the direction vector of the virtual microphone. In FIG. 7, this is illustrated as an example for a microphone 220. By inserting the angle into the general microphone equation $s(\varphi)=a+b*\cos(\varphi)$, a factor s is obtained for each source signal which corresponds to an additional sound attenuation due to the directivity. Prior to adding up all source signals, each signal is multiplied by the corresponding factor. There is, for example, the possibility to select between the directivities omnidirectional (a=1; b=0), subcardioid (a=0.71; b=29), cardioid (a=0.5; b=0.5), supercardioid (a=0.37; b=0.63), hypercardioid (a=0.25; b=0.75) and figure eight (a=0; b=1). The virtual microphone may, for example, be turned with an accuracy of 1° or less.

Figure 8:
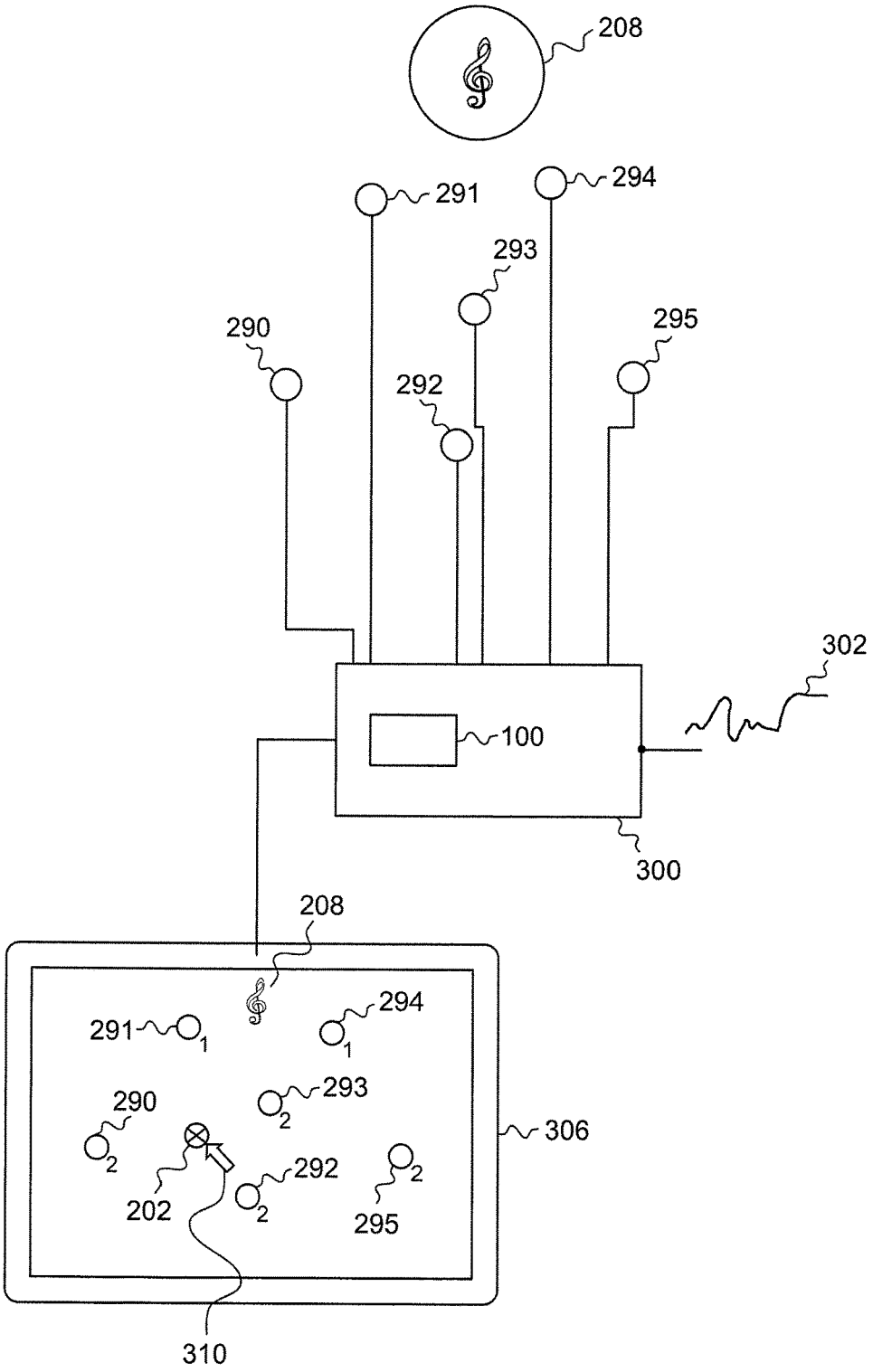
FIG. 8: shows a schematic representation of an embodiment of a mixing console.

FIG. 8 schematically shows a mixing console 300 comprising an audio signal generator 100 and by means of which signals of microphones 290 to 295 may be received which may be used to record an acoustic scene 208. The mixing console serves to process the source signals of at least two microphones 290 to 295 and to provide a mixed audio signal 302 which is merely indicated schematically in the representation opted for in FIG. 8.

According to some embodiments of the present invention, the mixing console further comprises a user interface 306 configured to indicate a graphic representation of the positions of the plurality of microphones 290 to 295, and also the position of a virtual listening position 202 which is arranged within the acoustic space in which the microphones 290 to 295 are located.

According to some embodiments, the user interface further allows to associate a microphone type with each of the microphones 290 to 295, such as a first type (1) which marks microphones for recording of direct sound and a second type (2) which refers to microphones for recording diffuse sound portions.

According to some further embodiments, the user interface is further configured to enable a user of the mixing console in a simple way, such as by moving a cursor 310 schematically illustrated in FIG. 8 and/or a computer mouse to intuitively and simply move the virtual position in order to allow for a check of the entire acoustic scene and/or the recording equipment in a simple manner.

Figure 9:
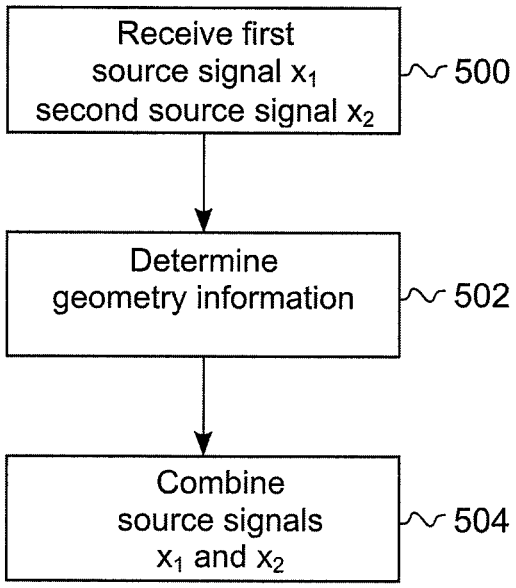
FIG. 9: shows a schematic representation of an embodiment of a method for generating an audio signal.

FIG. 9 schematically shows an embodiment of a method for providing an audio signal which comprises, in a signal recording step 500, receiving a first source signal $x_1$ recorded by a first microphone and a second source signal $x_2$ recorded by a second microphone.

During an analyzing step 502, a first piece of geometry information is determined based on the first position and the virtual listening position and a second piece of geometry information is determined based on the second position and the virtual listening position. In a combination step 505, at least the first source signal $x_1$ and the second source signal $x_2$ are combined according to a combination rule using the first piece of geometry information and the second piece of geometry information.

FIG. 10 shows again a schematic representation of a user interface 306 for an embodiment of the invention which slightly differs from the one shown in FIG. 8. In the same and/or in a so-called "interaction canvas", the positions of the microphones may be indicated, particularly as sound sources and/or microphones of various types and/or microphone types (1, 2, 3, 4). For this purpose, the position of at least one recipient and/or one virtual listening position 202 may be indicated (circle with a cross). Each sound source may be associated with one of the mixing console channels 310 to 316.

Even though the generation of a single audio signal at a virtual listening position 202 was mainly discussed using the preceding embodiments, it goes without saying that, according to further embodiments of the present invention, multiple, e.g., 2, 3, 4, up to any number of audio signals may also be generated for further virtual listening positions, wherein the combination rules described above are used in each case.

In this respect, different listening models, e.g. of the human hearing, may also be generated according to further embodiments, e.g., by using multiple, spatially neighboring, virtual listening positions. By defining two virtual listening positions which roughly have the distance of the human hearing and/or the auricle, a signal may be generated for each of the virtual listening positions, for example in connection with a frequency-dependent directivity, which simulates the auditory impression in direct listening using headphones or the like that a human listener would have at the location between the two virtual listening positions. That is, at the location of the left auditory canal and/or the left earpiece, the first virtual listening position would be generated which also comprises a frequency-dependent directivity so that the signal propagation could be simulated via the frequency-dependent directivity along the auditory canal in terms of a Head Related Transfer Function (HRTF). If one proceeded in the same way for the second virtual listening position with regard to the right ear, two mono signals would be obtained according to some embodiments of the present invention that, in direct listening, e.g., using headphones, would correspond to the sound impression which a real listener would have at the location of the virtual listening position.

In a similar way, a conventional stereo microphone may, for example, be simulated.

To summarize, the position of a sound source (e.g., of a microphone) in the mixing console/the recording software may be indicated and/or automatically captured according to some embodiments of the invention. Based on the position of the sound source, at least three new tools are available to the sound engineer:

- Monitoring of the spatial sound scene which is currently being registered.
- Creation of partly automated audio mixings by controlling virtual recipients.
- A visual representation of the spatial arrangement.

Figure 10:
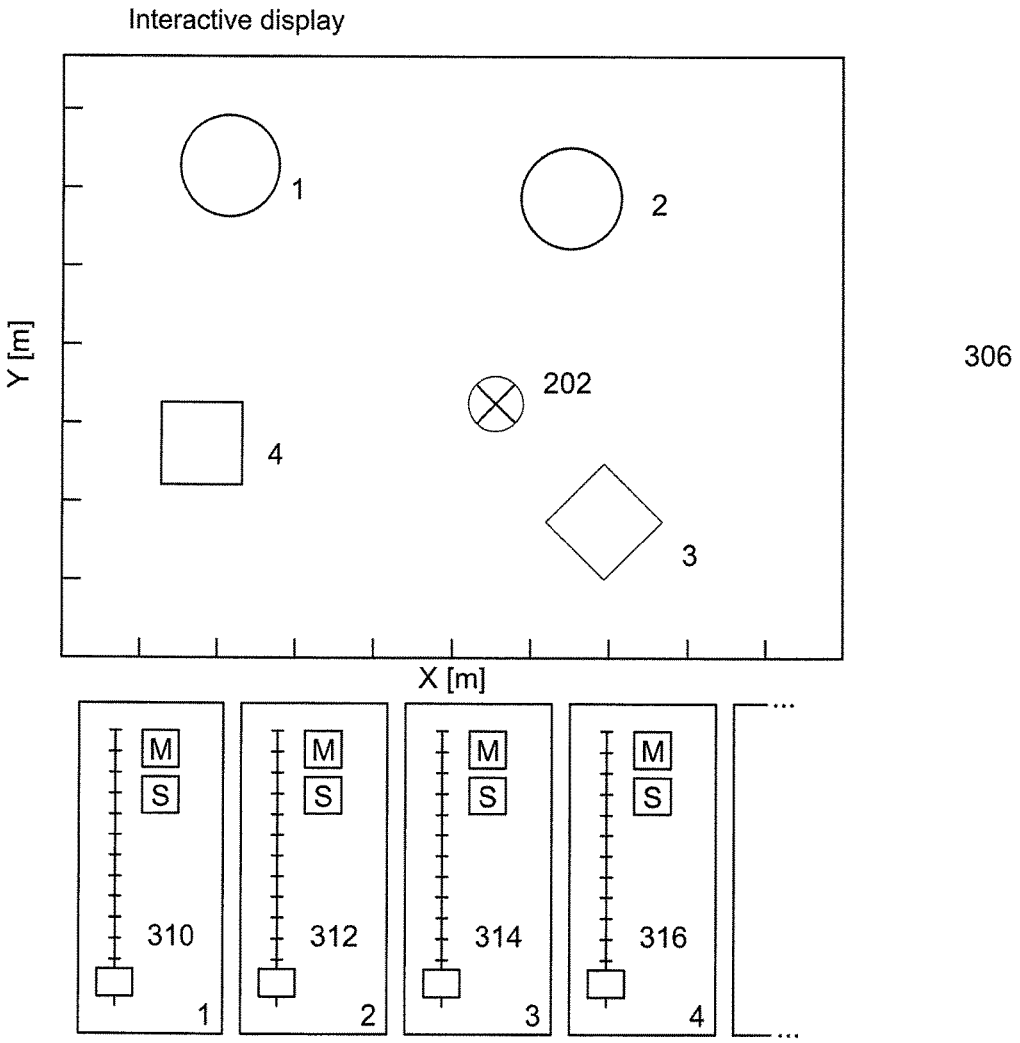
FIG. 10: shows a schematic representation of an embodiment of a user interface.

FIG. 10 shows schematically a potential user interface with the positions of the sound sources and one or several "virtual receivers". A position may be associated with each microphone (numbers 1 to 4) via the user interface and/or via an interaction canvas. Each microphone is connected to a channel strip of the mixing console/the recording software. By positioning one or several receivers (circle with a cross), the audio signals are calculated from the sound sources which may be used to monitor and/or find signal errors or create mixings. For this purposes, various function types are associated with the microphones and/or sound sources, e.g., close microphones ("D" type) or ambient microphones ("A" type), or a part of a microphone array which is only to be evaluated together with the other ones. Depending on the function, the calculation rules used are adjusted. Furthermore, the user is given the opportunity to configure the calculation of the output signal. Besides, further parameters may be set, e.g., the type of crossfading between neighboring microphones. Variable components and/or calculation procedures may be:

1. Distance-dependent volume
2. Volume interpolation between two or more sound sources
3. A small area around the respective sound source in which only the same can be heard (the distance value may be configured)

Such calculation rules of the recipient signals may be changed, e.g., by:

1. Indicating a recipient area around the sound source or the recipient,
2. By indicating a directivity for the recipient.

For each sound source, a type may be selected (e.g.: direct sound microphone, ambient microphone or diffuse sound microphone). The calculation rule of the signal at the recipient is controlled by the selection of the type.

In the specific application, this result in a particularly simple operation. Thus, preparation of a recording using a huge number of microphones is considerably simplified. A position in the mixing console may here already be associated with each microphone in the set-up process prior to the actual recording. The audio mixing does no longer need to take place via volume setting for each sound source at the channel strip, but may take place by indicating a position of the recipient in the sound source scene (e.g.: simple mouse click into the scene). Based on a selectable model for calculating the volume at the place of the recipient, a new signal is calculated for each new positioning of the recipient.

By "starting" the individual microphones, an interfering signal may thus be identified very quickly. In the same way, a spatial audio mixing may also be created by a positioning if the recipient signal is continued to be used as an output loudspeaker signal. Here, it is now no longer required to set a volume for each individual channel, the setting is carried out by simultaneously selecting the position of the recipient for all sound sources. In addition, the algorithms offer an innovative creative tool.

The schematic representation concerning the distance-dependent calculation of audio signals is shown in FIG. 3. Depending on the radius $R_L$, a volume g is calculated pursuant to $$g = \frac{1}{R_L^x}.$$

The variable x may assume various values depending on the type of the sound source, e.g., x=1; x=½. If the recipient is located in the circle having the radius $r_1$, a fixed (constant) volume value applies. The greater the distance of the sound source to the recipient, the quieter the audio signal is.

A schematic representation concerning the volume interpolation is shown in FIG. 5. The volume arriving at the recipient is here calculated using the position of the recipient between two or more microphones. The selection of the active sound sources may be determined by so-called "nearest neighbor" algorithms. The calculation of an audible signal at the place of the recipient and/or at a virtual listening position is done by an interpolation rule between two or more sound source signals. The respective volumes are dynamically adjusted here to allow a constantly pleasant volume for the listener.

In addition to activating all sound sources at the same time, using the distance-dependent volume calculation sound sources may be activated by a further algorithm. Here, an area around the recipient is defined with the radius R. The value of R may be varied by the user. If the sound source is located in this area, it is audible for the listener. This algorithm illustrated in FIG. 6 may also be combined with the distance-dependent volume calculation. Thus, there is an area around the recipient having the radius R. If sound sources are located within the radius, the same are audible to the recipient. If sound sources are located outside, their signal is not included in the calculation of the output signal.

To calculate the volume of the sound sources at the recipient and/or at the virtual listening position, it is possible to define a directivity for the recipient. The same indicates how strong the effect of the audio signal of a sound source is at the recipient depending on the direction. The directivity may be a frequency-dependent filter or a pure volume value. FIG. 7 shows this as a schematic representation. The virtual recipient is provided with a direction vector which may be rotated by the user. A selection of simple geometries may be available for selection to the user, as well as a selection of directivities of popular microphone types and also some examples of human ears to be able to create a virtual listener. The recipient and/or the virtual microphone at the virtual listening position comprises, for example, a cardioid characteristic. Depending on this directivity, the signals of the sound sources have a different impact in the recipient. According to the direction of incidence, the signals are attenuated differently.

According to another embodiment of the present invention, the mixing console, wherein the signal generator is configured to use a first combination rule if the first microphone and the second microphone are associated with a first microphone type, and to use a second combination rule if the first microphone and the second microphone are associated with a second microphone type.

A first near-field radius $r_1$ is used by the first combination rule and a second near-field radius $r_2$ is used by the second combination rule.

The first microphone type may be associated with a microphone which serves to record a direct sound portion of an acoustic scene, and wherein the second microphone type is associated with a microphone which is configured to record a diffuse sound portion of the acoustic scene.

The first combination rule comprises forming a weighted sum of the first source signal and the second source signal, with a first weight $g_1$ for the first source signal and a second weight $g_2$ for the second source signal, wherein the first weight $g_1$ for the first source signal is proportional to the inverse of a power of the first distance $d_1$, and the second weight $g_2$ for the second source signal is proportional to the inverse of a power of the second distance $d_2$.

The mixing console may be still further configured wherein the second combination rule comprises forming a weighted sum of the first source signal $x_1$ and the second source signal $x_2$, wherein the first weight $g_1$ and the second weight $g_2$ are dependent on the first piece of geometry information and on the second piece of geometry information, wherein the first weight $g_1$ and the second weight $g_2$ meet the boundary conditions for all possible geometry information such that a sum of the weights $G=g_1+g_2$ or a square sum $G2=g_1^2+g_2^2$ is constant or is 1.

The mixing console may be still further configured wherein the second combination rule comprises forming a weighted sum $x_{virt}$ of the first source signal $x_1$ and the second source signal $x_2$ according to at least one of the following crossfade rules:

Crossfade rule 1: $x_{virt1}=g_1*x_1+(1-g_1)*x_2$, wherein $g_2=(1-g_1)$;

Crossfade rule 2: $x_{virt2}=\cos(\delta)*x_1+\sin(\delta)*x_2$, wherein $\delta\in[0°; 90°]$;

Crossfade rule 3:

$$x_{virt3} = g_1 * x_1 + g_2 * x_2, \text{ wherein } \frac{\tan\theta}{\tan\theta_o} = \frac{g_1 - g_2}{g^1 + g_2} \text{ and } \theta \in [0°; 90°];$$

Crossfade rule 4:

$$x_{virt4} = g_1 * x_1 + g_2 * x_2, \text{ wherein } \frac{\sin\theta}{\sin\theta_o} = \frac{g_1 - g_2}{g^1 + g_2} \text{ and } \theta \in [0°; 90°].$$

The combination rule may further comprise forming a weighted sum $x_{virt}$ from the signals $x_{virt1}$ and $x_{virt23}$ weighted by a correlation coefficient $\sigma_{x1x2}$ for a correlation between the first source signal $x_1$ and the second source signal $x_2$ according to the following rule:

$$x_{virt}=\sigma_{x1x2}*x_{virt1}+(1-\sigma_{x1x2})*x_{virt23},$$

wherein $x_{virt23}$ is either $x_{virt2}$ or $x_{virt3}$.

A third source signal $x_3$ with a third weight $g_3$ is considered in forming the weighted sum according to the second combination rule, wherein the positions of the microphones associated with the first source signal $x_1$, the second source signal $x_2$ and the third source signal $x_3$ span a triangular surface within which the virtual listening position is located, and wherein the first weight $g_1$, the second weight $g_2$ and the third weight $g_3$ are determined for each of the first source signal $x_1$, the second source signal $x_2$ and the third source signal $x_3$, in each case based on a vertical projection of the virtual listening position onto such height of the triangle which is associated with the position of the microphone associated with the respective source signal.

The features disclosed in the above description, the following claims and the accompanying figures may, both individually and in any combination, be of importance and be implemented for the realization of an embodiment in their various configurations.

Although some aspects were described in connection with an audio signal generator, it is understood that these aspects also represent a description of the corresponding method so that a block or a device of an audio signal generator may also be understood to be a corresponding method step or a feature of a method step. Similarly, aspects which were described in connection with one or as a method step also represent a description of a corresponding block or detail or feature of the corresponding audio signal generator.

Depending on specific implementation requirements, embodiments of the invention may be implemented in hardware or in software. The implementation may be performed using a digital storage medium, e.g. a floppy disk, a DVD, a Blu-ray disc, a CD, a ROM, a PROM, an EPROM, an EEPROM or a flash memory, a hard drive or any other magnetic or optical memory, on which electronically readable control signals are stored which may interact, or interact, with a programmable hardware component such that the respective method is executed.

A programmable hardware component may be formed by a processor, a computer processor (CPU=Central Processing Unit), a graphics processor (GPU=Graphics Processing Unit), a computer, a computer system, an application-specific integrated circuit (ASIC), an integrated circuit (IC), a System on Chip (SOC), a programmable logic element or a field programmable gate array with a microprocessor (FPGA=Field Programmable Gate Array).

The digital storage medium may therefore be machine-readable or computer-readable. Some embodiments also comprise a data carrier which comprises electronically readable control signals capable of interacting with a programmable computer system or a programmable hardware component such that one of the methods described herein is executed. Thus, an embodiment is a data carrier (or a digital storage medium or a computer-readable medium) on which the program is recorded for executing one of the methods described herein.

In general, embodiments of the present invention may be implemented as a program, firmware, computer program or a computer program product having a program code or as data, wherein the program code or the data is effective to execute one of the methods if the program runs on a processor or a programmable hardware component. The program code or the data may, for example, also be stored on a machine-readable carrier or data carrier. The program code or the data may be available as a source code, machine code or byte code amongst others, and as another intermediate code.

Another embodiment is furthermore a data stream, a signal order or a sequence of signals which represent(s) the program for executing one of the methods described herein. The data stream, the signal order or the sequence of signals may, for example, be configured to be transferred via a data communication connection, e.g., via the internet or another network. Therefore, embodiments are also signal orders which represent data and which are suitable for being sent via a network or a data communication connection, wherein the data represents the program.

A program according to an embodiment may implement one of the methods during its execution by, for example, reading out its storage locations or by writing a datum or several data into the same, whereby, if appropriate, switching operations or other operations are caused in transistor structures, in amplifier structures or in other electrical components, optical components, magnetic components or components working according to another operating principle. Accordingly, by reading out a storage location, data, values, sensor values or other information may be captured, determined or measured by a program. Therefore, a program may capture, determine or measure quantities, values, measured quantities and other information by reading out one or several storage locations, and may effect, arrange for or carry out an action and control other equipment, machines and components by writing into one or several storage locations.

The embodiments described above merely illustrate the principles of the present invention. It will be understood that modifications and variations of the arrangements and details described herein are clear to other persons skilled in the art. Therefore, it is intended that the invention be merely limited by the scope of the following patent claims and not by the specific details which were presented on the basis of the description and the explanation of the embodiments.

What is claimed is:

1. A mixing console, comprising:

an audio signal generator comprising a signal generator for providing an audio signal for a virtual listening position within a space, in which an acoustic scene is recorded by at least a first microphone at a first known position within the space as a first source signal, and by at least a second microphone at a second known position within the space as a second source signal, wherein the audio signal generator comprises:

an input interface configured to receive the first source signal recorded by the first microphone and the second source signal recorded by the second microphone;

a geometry processor configured to determine a first piece of geometry information based on the first known position and the virtual listening position, and a second piece of geometry information based on the second known position and the virtual listening position;

wherein the signal generator is configured to combine at least the first source signal and the second source signal to provide the audio signal according to a combination rule using the first piece of geometry information and the second piece of geometry information wherein the mixing console is configured to process and combine at least the first and the second source signal for providing a mixed audio signal.

2. The mixing console according to claim 1, the mixing console further comprising a user interface configured to indicate a graphic representation of the positions of a plurality of microphones comprising at least the first and the second microphones and the virtual listening position.

3. The mixing console according to claim 2, wherein the user interface further comprises an input device configured to associate each microphone with a microphone type from a group comprising at least a first microphone type and a second microphone type, wherein a microphone type corresponds to one kind of a sound field recorded using the microphone.

4. The mixing console according to claim 2, wherein the user interface further comprises an input device configured to input or change at least the virtual listening position by influencing a graphic representation of the virtual listening position.

5. The mixing console according to claim 1, wherein the first piece of geometry information comprises a first distance between the first known position and the virtual listening position, and the second piece of geometry information comprises a second distance between the second position and the virtual listening position.

6. The mixing console according to claim 5, wherein the combination rule comprises forming a weighted sum of the first source signal and the second source signal, wherein the first source signal is weighted by a first weight g1 and the second source signal by a second weight g2.

7. The mixing console according to claim 6, wherein the first weight g1 for the first source signal is proportional to an inverse of a power of the first distance d1, and the second weight g2 for the second source signal is proportional to an inverse of a power of the second distance d2.

8. The mixing console according to claim 7, wherein the first weight g1 for the first source signal is proportional to a multiplication of a near-field radius r1 of the first microphone by the inverse of the first distance d1, and the second weight g2 for the second source signal is proportional to a multiplication of a near-field radius r2 of the second microphone by the inverse of the second distance d2.

9. The mixing console according to claim 6, wherein the first weight g1 for the first source signal is zero if the first distance d1 is greater than a predetermined listening radius R, otherwise the first weight g1 is 1, and the second weight g2 for the second source signal is zero if the second distance d2 is greater than the predetermined listening radius R, otherwise the second weight g2 are is 1.

10. The mixing console according to claim 5, wherein, according to the combination rule, either the first source signal or the second source signal is delayed by a delay time if a comparison of the first piece of geometry information and the second piece of geometry information meets a predetermined criterion.

11. The mixing console according to claim 10, wherein the predetermined criterion is met if a difference between the first distance and the second distance is smaller than an operable minimum distance.

12. The mixing console according to claim 1, wherein, according to the combination rule, a signal from a group of the first source signal and the second source signal having a shorter signal propagation time from the microphone associated with the signal to the virtual listening position is delayed such that a resultant delayed signal propagation time corresponds to a signal propagation time from the microphone associated with the other signal of the group to the virtual listening position.

13. The mixing console according to claim 6, wherein the first piece of geometry information further comprises a first piece of directional information about a direction between a preferred direction associated with the virtual listening position and the first known position, and a second piece of directional information about a direction between the preferred direction and the second position, wherein the first weight g1 is proportional to a first directional factor and wherein the second weight g2 is proportional to a second directional factor, and wherein the first directional factor depends on the first piece of directional information and on a directivity associated with the virtual listening position, and the second directional factor depends on the second piece of directional information and the directivity.

* * * * *